US006040534A

United States Patent [19]

Beukema

[11] Patent Number: 6,040,534

[45] Date of Patent: Mar. 21, 2000

[54] INTEGRALLY MOLDED SWITCH LIGHTING AND ELECTRONICS

[75] Inventor: Jack A. Beukema, Holland, Mich.

[73] Assignee: Prince Corporation, Holland, Mich.

[21] Appl. No.: 09/170,736

[22] Filed: Oct. 13, 1998

[51] Int. Cl.[7] ..... H01H 13/70; H01H 9/18

[52] U.S. Cl. ..... 200/5 A; 200/314

[58] Field of Search ..... 200/5 A, 512, 200/5.3, 516, 517, 341, 310, 313, 314, 317; 400/472, 490, 491, 491.2, 495

[56] References Cited

U.S. PATENT DOCUMENTS

| | | | |
|---|---|---|---|
| 3,339,104 | 8/1967 | Kushner et al. | 315/55 |
| 3,699,294 | 10/1972 | Sudduth | 200/166 C |
| 4,060,703 | 11/1977 | Everett, Jr. | 200/5 A |
| 4,254,362 | 3/1981 | Tulleners | 315/219 |
| 4,266,164 | 5/1981 | Schroeder | 315/169.1 |
| 4,354,077 | 10/1982 | McMains et al. | 200/314 |
| 4,493,958 | 1/1985 | Hamilton et al. | 200/314 |
| 4,532,395 | 7/1985 | Zukowski | 200/314 |
| 4,551,717 | 11/1985 | Dreher | 340/712 |
| 4,623,768 | 11/1986 | Gnant | 200/159 B |
| 4,683,359 | 7/1987 | Wojtanek | 200/314 |
| 4,683,360 | 7/1987 | Maser | 200/314 |
| 4,703,160 | 10/1987 | Narishima et al. | 235/1 D |
| 4,772,769 | 9/1988 | Shumate | 200/314 |
| 4,811,175 | 3/1989 | DeSmet | 362/95 |
| 4,812,831 | 3/1989 | Laier | 340/711 |
| 4,837,412 | 6/1989 | Tachibana | 200/5 A |
| 4,934,735 | 6/1990 | Embach | 280/731 |
| 5,122,626 | 6/1992 | Shinohara et al. | 200/457 |
| 5,440,208 | 8/1995 | Uskali et al. | 315/169.3 |
| 5,465,091 | 11/1995 | Nishino et al. | 341/33 |
| 5,483,503 | 1/1996 | Kimball | 368/67 |
| 5,504,661 | 4/1996 | Szpak | 362/30 |
| 5,510,782 | 4/1996 | Norris et al. | 341/22 |
| 5,569,893 | 10/1996 | Seymour | 200/61.54 |
| 5,570,114 | 10/1996 | Fowler | 345/173 |
| 5,664,860 | 9/1997 | Berardi | 362/23 |
| 5,669,486 | 9/1997 | Shima | 200/314 |
| 5,697,493 | 12/1997 | Sach et al. | 200/314 |
| 5,747,756 | 5/1998 | Boedecker | 200/5 A |
| 5,797,482 | 8/1998 | LaPointe et al. | 200/314 |
| 5,871,088 | 2/1999 | Tanabe | 200/514 |

FOREIGN PATENT DOCUMENTS

| | | | |
|---|---|---|---|
| 2512228 | 10/1975 | Germany | H01H 13/52 |
| 3511496 | 10/1986 | Germany | H01H 9/18 |
| 1159917 | 6/1989 | Japan | H01H 13/02 |
| 2265123 | 10/1990 | Japan | H01H 13/02 |
| 2213648 | 8/1989 | United Kingdom | H01H 9/18 |

*Primary Examiner*—Michael Friedhofer
*Attorney, Agent, or Firm*—Price, Heneveld, Cooper, DeWitt & Litton

[57] ABSTRACT

A display/switch/electronic control assembly includes a molded three-piece assembly in which displays/switches/electronics are integrally included on a flexible circuit material sandwiched between a polymeric substrate and a cover, which may include a switching element cooperating with the flex circuit, or a display. The structure preferably is insert-molded with integrally molded sections for providing an inexpensive, reliable control and display system for use in the vehicle environment.

13 Claims, 1 Drawing Sheet

INTEGRALLY MOLDED SWITCH LIGHTING AND ELECTRONICS

BACKGROUND OF THE INVENTION

The present invention relates to an integrally molded illuminated display which may include switch contacts and control electronics, and particularly one for use in the automotive environment for instrument panels.

In recent years, the control of vehicle operational systems has become more electronic in nature, utilizing a variety of backlighted switches, touch screens and electroluminescent displays not only for the display of information, but for the control of a variety of vehicle accessories such as the HVAC system, windows, locks and the like. The use of electroluminescent displays provides a modern, convenient and readily readable display of not only information, but also the illumination of switches to be actuated under low ambient light conditions for identifying the switch location and its control function. Although a variety of backlighted switches and electroluminescent displays have been provided, typically they require multiple pieces with specific assembly difficulties and can be prone to failure under operating conditions encountered in the automotive environment. Accordingly, there exists a need for a system which provides a display, a backlighted switch and/or electronics associated therewith in an inexpensively molded package which can be readily assembled and provide a reliable system for use in the automotive environment. The cost of such a system also should be minimized to accommodate the cost-conscious needs of the automotive industry.

SUMMARY OF THE INVENTION

The molded system of the present invention provides such a display/switch/electronic control assembly by utilizing a molded three-piece assembly in which displays/switches/electronics can be integrally included on a flexible circuit material sandwiched between a polymeric substrate and a cover, which may include a switching element cooperating with the flex circuit and/or a display. The structure preferably is insert-molded with integrally molded sections for providing an inexpensive, reliable control and display system for use in the vehicle environment.

These and other features, objects and advantages of the present invention will become apparent upon reading the following description thereof together with reference to the accompanying drawings.

DETAILED DESCRIPTION OF THE PREFERRED EMBODIMENT

Figure 1:
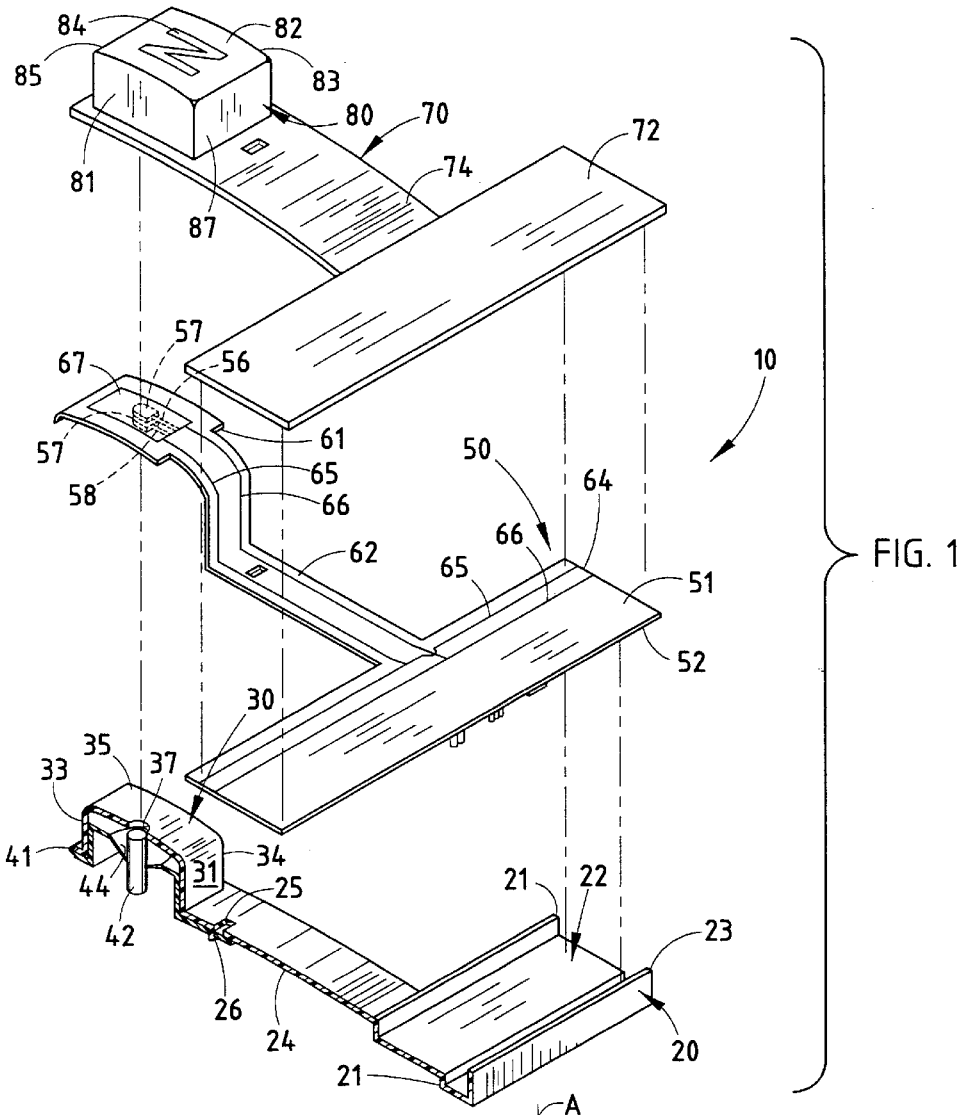
FIG. 1 is an exploded fragmentary perspective view of a section of a switch, display and electrical control assembly embodying the present invention.

Referring initially to FIG. 1, there is shown a backlighted switch assembly and control circuit 10 of the present invention, which may be part of a continuous array of a plurality of such units, with the switch and circuitry shown in FIG. 1 being representative of one such unit of the array. The assembly 10 comprises an underlying polymeric substrate 20 which is defined by a generally U-shaped channel 22 at one end with upstanding end walls 21 and 23. Channel

22 extends the length of the array, which may include a plurality of switches, displays or other elements housed within the elongated channel 22. Extending orthogonally from channel 22 is an arm 24, which includes an aperture 25, and a snap-locking tab 26 centered within arm 24. Arm 24 terminates in a rectangular raised cap or housing 30 having integral sidewalls 32 and 34, front wall 31, and a rear wall 33 extending upwardly from arm 24 near its end and having an integral top 35 with an aperture 37 formed therein with a diameter slightly larger than the diameter of an underlying switch actuator 40 including a rod-shaped actuator 42 suspended on an integrally formed extension as described below.

Figure 2:
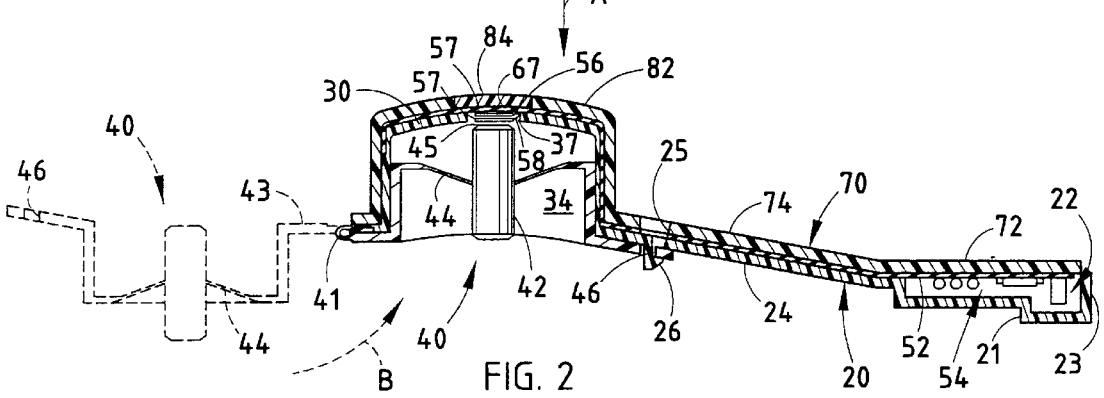
FIG. 2 is a cross-sectional view of the structure shown in FIG. 1 once assembled, showing in phantom form the molded position of one of the elements.

Substrate 20 is integrally formed by molding elements 21–27 made of a polymeric material such as polycarbonate or other suitable material employed in the automotive environment, and integrally includes section 40 comprising a carbon-filled elastomeric material such that switch actuator 42 is sufficiently conductive to provide a switch contact as described in greater detail below. The section 40 is coupled to substrate 20 by a living hinge 41 integrally molded between the end of arm 24 and the floor 43 of section 40. The rod-shaped switch actuator 42 is suspended by a relatively thin circumferential web 44 and can be moved as seen in FIG. 2 from the position (shown in phantom form) as molded extending laterally from the remaining section of the substrate 20. Subsequently, section 40 is snapped into position with aperture 46 of section 40, snapping over locking tab 26 as seen in solid lines in FIG. 2 for positioning switch actuator 42 in centered alignment with aperture 37. Actuator 42 has a switch contacting end 45 which is positioned slightly within aperture 37 as seen in FIG. 2 such that, as described below, the deflection of a flex circuit and cover section of assembly 10 causes actuation of the switch contained within the assembly.

Overlying substrate 20 is a flex circuit 50 which is preferably a polymeric film, such as Mylar®, having conductive tracings on both the upper surface 51 and the lower surface 52 with an electrical control circuit 54 (FIG. 2) mounted to the lower surface 52 and communicating with switch tracings 56 and 58 (FIG. 1). Switch tracings 56 and 58 comprise electrical conductors printed on the lower surface 52 of the polymeric substrate flex circuit 50 and terminate in spaced-apart switch pads 57 which are aligned with aperture 35 and which, when deflected against the end 45 carbon-filled elastomeric switch actuator 42, close the switch, providing a signal to control circuit 54 which responds thereto to provide a desired control function such as raising or lowering a window, changing the temperature in the HVAC system, or any other desired control function. The polymeric flex circuit 50 also includes a light-emitting phosphorous pad 60 deposited on the rectangular end 61 of the top surface 51 of flex circuit 50. Circuit 50 includes an arm 62 coupling the rectangular end 61 to the elongated body 64 of the flex circuit which extends within channel 22 of substrate 20 and extends along channel 22 to other control or display elements of the array.

Light-emitting phosphorous surface 60 is coupled to conductors 65 and 66 which are printed on the upper surface 51 of flex circuit 50 and provide an actuating voltage under low ambient conditions controlled by the vehicle's lighting system for backlighting an indicia 84 formed on the cover 70 of the assembly 10.

Covering the substrate 20 and flex circuit 50 is cover 70 which, like the remaining two elements, has an elongated, generally rectangular section 72 overlying and covering channel 22, an arm 74 overlying and covering arms 24 and 62, and a rectangular housing 80 positioned at the end of arm 74 and including an upper surface 82 with translucent indicia 84 integrally molded thereon and aligned with phosphorous electroluminescent pad 67 to be lighted thereby upon activation of the phosphorous pad. Cover 70 is made of a thin, flexible polycarbonate film with top wall 82 supported by sidewalls 81 and 83 and end walls 85 and 87 to be sufficiently resilient to allow the deflection of both the upper wall 82 and the pad 67 of polymeric flex circuit 50 upon depression of button forming extension 80 in a direction indicated by arrow A in FIG. 2 such that switch contacts 57 contact the conductive end 45 of switch actuator 42 closing the switch to provide a control signal. In a preferred embodiment of the invention, the substrate 20 is made of polycarbonate and has a thickness of approximately 1.5 mm. The flex circuit 50 is made of a polymeric film, such as Mylar®, having a thickness of approximately 0.05 mm, while the polymeric film cover 70 can be made of polycarbonate having a thickness of approximately 0.25 mm. The cover, flex circuit, and substrate are sandwiched together as shown in FIG. 2. The resultant assembly is relatively inexpensive and provides not only a display such as indicia 84 but can integrally incorporate such a display with a switch actuator defining a switch which communicates to the control circuit 54 for providing electrical control signals for the operation of various vehicle accessories. The system may incorporate either a backlighted display provided by electroluminescent pad 67 and indicia 84 with or without the addition of the switch defined by contacts 57 on flex circuit 50 and actuator 42, or provide a switch without the backlighted display indicia but with conventionally imprinted indicia. The cover 70 is integrally molded with the translucent indicia 84 molded in place. The cover 70 may be manufactured of any desired color and texture of material formed by current film processing techniques, including the desired indicia 84. The flex circuit 50 during manufacture is inserted into the mold for the substrate 20 and cover 70 for insert molding the rigid polycarbonate substrate material comprising elements 21–37 and section 40 comprising a soft carbon-filled elastomeric material. Once molded, section 40 is hinged over in a direction indicated by arrow B in FIG. 2 onto locking tab 26 to complete the assembly 10 which, as noted above, may include an array of several such displays and/or a combination of switches, displays and electronics.

It will become apparent to those skilled in the art that various modifications to the preferred embodiment can be made without departing from the spirit or scope of the invention as defined by the appended claims.

The invention claimed is:

1. An integrated electrical control assembly comprising:

a polymeric cover including a graphic element formed thereon;

a flex circuit including an electroluminescent panel, said panel positioned within said cover to be aligned with said graphic element; and a substrate sandwiching said flex circuit to said cover, wherein said substrate includes a first section of a rigid polymeric material and a second section including a carbon-filled elastomeric material and wherein said flex circuit includes switch contacts aligned with a switch actuator formed in said elastomeric material to define a switch.

2. The integrated electrical control assembly as defined in claim 1 wherein an electrical circuit is formed on said flex circuit and coupled to said switch.

3. The integrated electrical control assembly as defined in claim 1 wherein said graphic element comprises translucent indicia.

4. The integrated electrical control assembly as defined in claim 1 wherein said flex circuit is molded in place between said cover and substrate.

5. The integrated electrical control assembly as defined in claim 4 wherein said flex circuit includes a polymeric film with said electroluminescent panel formed on one side.

6. The integrated electrical control assembly as defined in claim 1 wherein said flex circuit includes switch contacts aligned on a side of said circuit opposite said panel.

7. A molded electrical control assembly comprising:

a molded polymeric cover including a resilient switch button having a translucent graphic element formed thereon;

a flex circuit including an electroluminescent panel on one side, positioned within said cover with said panel aligned with said graphic element and switch contacts on a side opposite said panel; and a substrate having a contact pad aligned with said switch contacts, said substrate sandwiching said flex circuit to cover, wherein said substrate includes a first section of a rigid polymeric material and a second section including a carbon-filled elastomeric material and wherein said switch pad is formed in said elastomeric material.

8. The integrated electrical control assembly as defined in claim 7 wherein an electrical circuit is formed on said flex circuit and coupled to said switch contacts.

9. The integrated electrical control assembly as defined in claim 8 wherein said flex circuit is molded in place between said cover and substrate.

10. An integrated electrical control assembly comprising:

a polymeric cover including a flexible switch actuating button formed thereon;

a flex circuit including switch contacts formed thereon and aligned with said button; and a substrate sandwiching said flex circuit to said cover, wherein said polymeric cover and said substrate are integrally molded with said flex circuit positioned therebetween, wherein said substrate includes a first section of a rigid polymeric material and a second section including a carbon-filled elastomeric material and wherein said flex circuit switch contacts are aligned with a switch actuator formed in said elastomeric material to define a switch.

11. The integrated electrical control assembly as defined in claim 10 wherein said button includes indicia thereon identifying said switch.

12. The integrated electrical control assembly as defined in claim 11 wherein said indicia comprise a translucent graphic element.

13. The integrated electrical control assembly as defined in claim 12 wherein said flex circuit includes an electroluminescent panel on a side opposite said switch contacts for illuminating said graphic element and electronic components to drive the illumination and switch function.

* * * * *